US007708593B1

(12) United States Patent
Gherardini et al.

(10) Patent No.: US 7,708,593 B1
(45) Date of Patent: May 4, 2010

(54) ELECTRICAL CONNECTOR HAVING AN ENCAPSULANT TO SEAL THE CONNECTOR

(76) Inventors: Stephen D. Gherardini, 532 Clermont Dr., Harrisburg, PA (US) 17112; Paul D. Roman, Jr., 301 Chestnut St., Harrisburg, PA (US) 17101

( * ) Notice: Subject to any disclaimer, the term of this patent is extended or adjusted under 35 U.S.C. 154(b) by 0 days.

(21) Appl. No.: 12/473,474

(22) Filed: May 28, 2009

(51) Int. Cl.
*H01R 13/58* (2006.01)

(52) U.S. Cl. ..... 439/604; 439/936

(58) Field of Classification Search ..... 439/519, 439/521, 604, 936; 174/76
See application file for complete search history.

(56) References Cited

U.S. PATENT DOCUMENTS 4,767,345 A * 8/1988 Gutter et al. ..... 439/92
5,795,170 A * 8/1998 Okabe ..... 439/252
7,052,301 B2 * 5/2006 Garcia et al. ..... 439/336
7,063,575 B2 * 6/2006 Powers et al. ..... 439/699.2
7,390,217 B2 * 6/2008 Scott ..... 439/604
7,497,724 B1 * 3/2009 Fong et al. ..... 439/497

* cited by examiner

*Primary Examiner*—Thanh-Tam T Le

(57) ABSTRACT

An electrical connector includes a housing, a cable, a contact and an encapsulant. The housing extends from a cable exit to an opposite end along a longitudinal axis and from a mounting face to a top face along a vertical axis. The housing includes a cable opening that extends into the cable exit in a direction parallel to the longitudinal axis and a window extending into the housing from the top face toward the mounting face in a direction parallel to the vertical axis. The cable extends through the window and into the housing through the cable opening. The contact is held by the housing and is configured to electrically couple the cable with a mating device when the housing face of the housing is mounted to the mating device. The encapsulant is disposed within the window to seal an interface between the cable and the housing. The encapsulant prevents ingress of moisture into the housing through the interface.

18 Claims, 4 Drawing Sheets

ELECTRICAL CONNECTOR HAVING AN ENCAPSULANT TO SEAL THE CONNECTOR

BACKGROUND OF THE INVENTION

The subject matter herein relates generally to electrical connectors and, more particularly, for electrical connectors that are coupled with one or more cables.

Some known electrical connectors are joined with cables to electrically couple the connectors with the cables. For example, the connectors may include contacts that engage a mating device. The contacts electrically join the connector with the mating device. The cable typically includes one or more conductors enclosed by an insulative jacket extending along the interior of the cable throughout the length of the cable. The cable is connected with the connector with the conductors electrically terminated with the contacts to electrically couple the cable with the contacts. Thus, the connector electrically connects the mating device with the cable. Electrical power and/or signals may then be communicated between the mating device and the cable. In applications where the mating device is a solar module or panel, the connector may communicate electric potential or current from the solar module or panel to another mating device via the cable.

In some applications, the cables joined with the connectors may experience significant forces that pull the cable away from the housing of the connector. For example, environmental factors such as ice and snow may add weight to the cables joined to connectors on solar panels. This additional weight may pull the cables away from the connectors. If the cables are not affixed to the connectors in a sufficiently strong manner, the cables may become detached from the housings of the connectors.

Some known connectors include retention mechanisms that assist in preventing the cable from being separated from the connector housing. But, these retention mechanisms may be relatively large. For example, some known solar module connectors include pinch ring and nut combinations to secure cables to the connector housings. The pinch ring is a ring that is placed around the cable. The pinch ring includes several slots that permit the ring to be compressed down onto the cable. The nut is placed into the connector. The pinch ring is screwed into the nut to compress the pinch ring onto the cable and to couple the cable with the connector. The pinch ring is compressed around the cable when the nut is screwed down or tightened onto the connector. But, the size of the nut limits the size of the connector. That is, the size of the connector typically must be at least as large as the nut. As a result, the profile height of the connector is limited by the size of the nut. In certain applications, the size of the nut may require the connector to have a profile height that is too large. For example, the location in which some solar module connectors are required may be too small to fit a connector having a nut and pinch ring combination.

The interface between the cable and the housing at the opening provides a location where moisture can enter into the housing. In connectors that have too small of a profile to permit use of the pinch ring and nut combination, the cable/housing interface may be exposed to the atmosphere surrounding the connector. In conditions where the cable and housing experience changes in temperature, differences between coefficients of thermal expansion between the cable and the housing may result in a gap forming at the cable/housing interface. For example, the housing may be formed of a material that expands and contracts a greater distance than the material of the outer jacket of the cable over a common change in temperature. When the connector is used in environments experiencing relatively large temperature changes, the differences in coefficients of thermal expansion may cause a relatively large gap to be formed. The gap permits moisture to seep into the interior of the housing, where the moisture can electrically short the contacts or other electrical components of the housing.

Thus, a need exists for a connector assembly that affixes cables to connectors in such a manner to maintain a relatively small profile height of the connector while preventing moisture from entering into the housing.

BRIEF DESCRIPTION OF THE INVENTION

In one embodiment, an electrical connector includes a housing, a cable, a contact and an encapsulant. The housing extends from a cable exit end to an opposite end along a longitudinal axis and from a mounting face to a top face along a vertical axis. The housing includes a cable opening that extends into the cable exit in a direction parallel to the longitudinal axis and a window extending from the housing from the top face toward the mounting face in a direction parallel to the vertical axis. The cable extends through the window and into the housing through the cable opening. The contact is held by the housing and is configured to electrically couple the cable with a mating device when the mounting face of the housing is mounted to the mating device. The encapsulant is disposed within the window to seal an interface between the cable and the housing. The encapsulant prevents ingress of moisture into the housing through the interface.

In another embodiment, another electrical connector is provided. The connector includes a housing, a cable, a contact and an encapsulant. The housing extends from a cable exit to an opposite end along a longitudinal axis and from a mounting face to a top face along a vertical axis. The housing frames a window extending through the housing from the top face to the mounting face. The cable is received into the housing through the cable exit. At least a portion of the cable is disposed within the window. The contact is held by the housing and is configured to electrically couple the cable with a mating device when the mounting face of the housing is mounted to the mating device. The encapsulant is disposed within the window to seal an interface between the cable and the housing. A web portion of the housing is disposed between the cable exit and the window to reduce a force that is imparted on the encapsulant to prevent separation between the encapsulant and at least one of the housing and the cable.

DETAILED DESCRIPTION OF THE INVENTION

Figure 1:
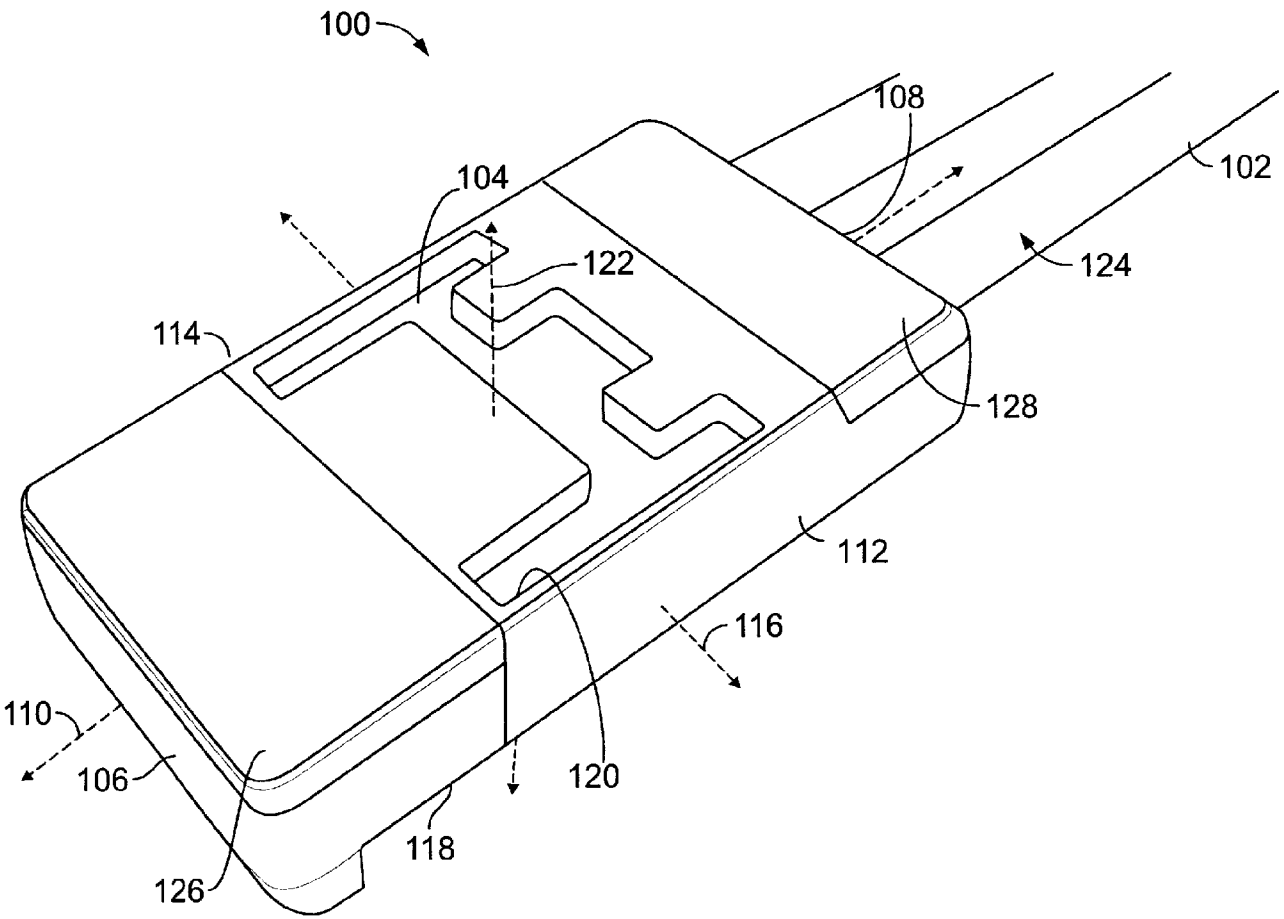
FIG. 1 is a perspective view of an electrical connector in accordance with one embodiment.

FIG. 1 is a perspective view of an electrical connector 100 in accordance with one embodiment. The connector 100 is mounted to a mating device (not shown) to electrically couple the connector 100 and mating device. In the illustrated embodiment, the connector 100 is a photovoltaic connector that is mounted to a solar module (not shown). The connector 100 mounts to the solar module to electrically couple the connector 100 and the solar module such that the electric potential or current generated by the solar module may be drawn through the connector 100. Cables 102 extending from the connector 100 communicate the electric potential or current generated by the solar module to an electrical load (not shown) and/or to another solar module. While two cables 102 are coupled with the connector 100 in the illustrated embodiment, a different number of cables 102 may be provided. Additionally, while the discussion herein focuses on photovoltaic connectors, one or more embodiments described below may be used as connectors for applications other than solar modules.

The connector 100 includes a housing 104 that extends between a cable exit 108 and an opposite end 106 along a longitudinal axis 110 and between opposite sides 112, 114 along a lateral axis 116. The housing 104 also extends from a mounting face 118 to an opposite top face 120 along a vertical axis 122. In the illustrated embodiment, the longitudinal axis 110, lateral axis 116 and vertical axis 122 are perpendicular to each another. The mounting face 118 engages the solar module (not shown) when the connector 100 is mounted to the solar module.

In one embodiment, the housing 104 104 includes or is formed from a dielectric material. The housing 104 may be a rigid, unitary body that is molded from a dielectric material. By way of example only, the housing 104 may be molded from a polyester, such as polybutylene terephthalate (PBT). In one embodiment, the housing 104 is formed of 30% glass fiber filled PBT. However, other materials and composites may be used to form the housing 104. The housing 104 may be formed by overmolding the housing 104 over portions of the cables 102. Alternatively, the housing 104 may be molded with the cables 102 later loaded into the housing 104 through the cable exit 108.

The cables 102 include one or more conductors (not shown) that are electrically coupled with contacts 224 (shown in FIG. 2) held in the housing 104. The conductors are circumferentially enclosed in an insulative sheath or jacket 124. The jacket 124 includes or is formed from a dielectric material. For example, in one embodiment, the jacket 124 may be formed from a flexible cross-linked polyolefin material.

The connector 100 includes a front end cover 126 and a rear end cover 128 in the illustrated embodiment. As described below, the front end cover 126 encloses a contact window 222 (shown in FIG. 2) in the housing 104 and the rear end cover 128 encloses cable windows 206 (shown in FIG. 2) in the housing 104. The front end cover 126 and rear end cover 128 enclose the contact window 222 and cable windows 206 to enclose an encapsulant 400 (shown in FIG. 4) that is disposed within the cable windows 206 and/or the contact window 222. Alternatively, the front and/or rear end covers 126, 128 are not included in the connector 100.

Figure 2:
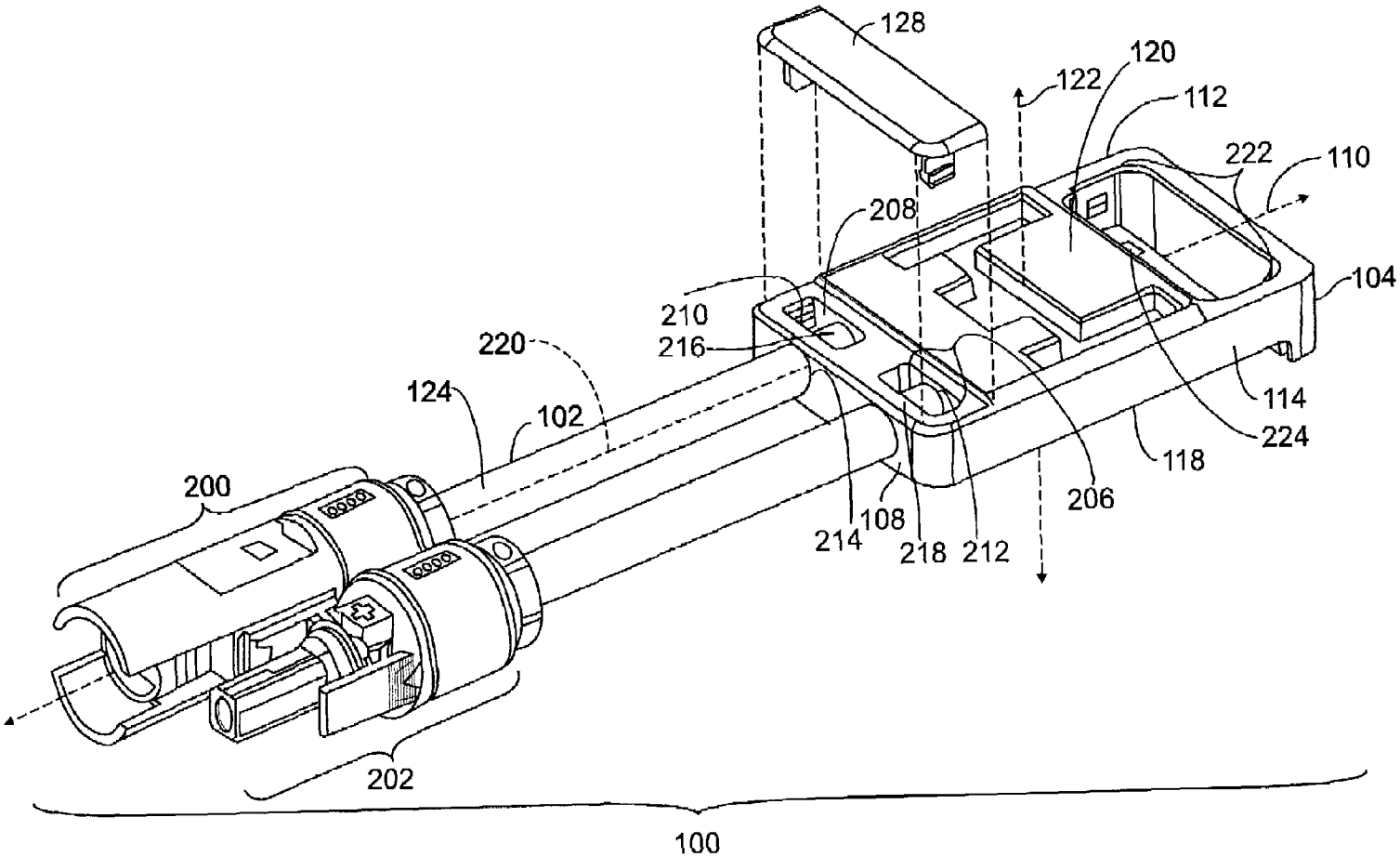
FIG. 2 a partially exploded view of the connector shown in FIG. 1 in accordance with one embodiment.

FIG. 2 a partially exploded view of the connector 100 in accordance with one embodiment. As shown in FIG. 2, the cables 102 include cable connectors 200, 202. The cable connector 202 is a plug connector and the cable connector 200 is a receptacle connector. The cable connectors 200, 202 mate with cable connectors 200, 202 on an external device (not shown), such as another connector 100, a solar module, an electrical load, and the like, to electrically join the connector 100 and the mating device (not shown) to which the connector 100 is mounted with the external device.

The cable windows 206 define openings into the housing 104 that extend from the top face 120 toward the mounting face 118 in directions parallel to the vertical axis 122. While two cable windows 206 are shown in FIG. 2, alternatively a single cable window 206 may be used. In one embodiment, the cable windows 206 extend completely through the housing 104 from the top face 120 to the mounting face 118. The housing 104 frames the cable windows 206 such that the housing 104 surrounds the cable windows 206 from the top face 120 to the mounting face 118. As shown in FIG. 2, the rear end cover 128 is placed over the cable windows 206 to enclose the cable windows 206. A web portion 218 of the housing 104 includes the section of the housing 104 that is disposed between the cable exit 108 and the cable windows 206, between the mounting face 118 and the top face 120, and between the sides 112, 114 of the housing 104.

The housing 104 includes inner walls 208, 210 that oppose one another across each of the cable windows 206. A portion 216 of each of the cables 102 is disposed in the cable windows 206 between the inner walls 208, 210 of each cable window 206. In the illustrated embodiment, each inner wall 208 includes a cable opening 212 through which the cables 102 extend. The cable openings 212 may be formed by the overmolding of the housing 104 onto the cables 102. The cable openings 212 are aligned with the longitudinal axis 110 of the housing 104. For example, the cables 102 may extend into the housing 104 through the cable openings 212 in a direction that is oriented approximately parallel to the longitudinal axis 110. The cable openings 212 may have a size that is approximately the same as the cables 102. For example, the cables 102 may have circular cross-sections and the cable openings 212 may be circular in shape. The diameters of the cable openings 212 may be approximately the same size as, or slightly smaller than, the diameters of the cables 102.

The housing 104 includes additional cable openings 214 disposed in the cable exit 108 of the housing 104 through which the cables 102 extend. Similar to the cable openings 212, the cable openings 214 may be formed when the housing 104 is overmolded onto the cables 102. As shown in FIG. 2, each of the openings 214 extends through the housing 104 from the cable exit 108 to the corresponding inner wall 210 in a direction that is oriented approximately parallel to the longitudinal axis 110. Similar to the cable openings 212, the openings 214 may have an approximately circular shape with diameters that are approximately the same as the diameters of the cables 102. In the illustrated embodiment, the openings 214 are axially aligned with the cable openings 212 such that the cables 102 are loaded through the openings 214 and into the cable openings 212 in directions that are oriented approximately parallel to the longitudinal axis 110. For example, center axes 220 of the cables 102 are oriented approximately parallel to the longitudinal axis 110 within the cable windows 206.

The housing 104 includes the contact window 222 in the illustrated embodiment. The contact window 222 defines an opening into the housing 104 that extends from the top face 120 toward the mounting face 118 in a direction that is parallel to the vertical axis 122. In one embodiment, the contact window 222 extends completely through the housing 104 from the top face 120 to the mounting face 118. The housing 104 frames the contact window 222 such that the housing 104 surrounds the contact window 222 from the top face 120 to the mounting face 118. One or more of the contacts 224 are held by the housing 104 and extend into the contact window 222. The contact window 222 may provide visual access to the contacts 224 to ensure that the contacts 224 engage mating contacts (not shown) of a mating device (not shown) when the connector 100 is mounted to the mating device. For example, the contacts 224 may be soldered or welded to the mating contacts.

Figure 3:
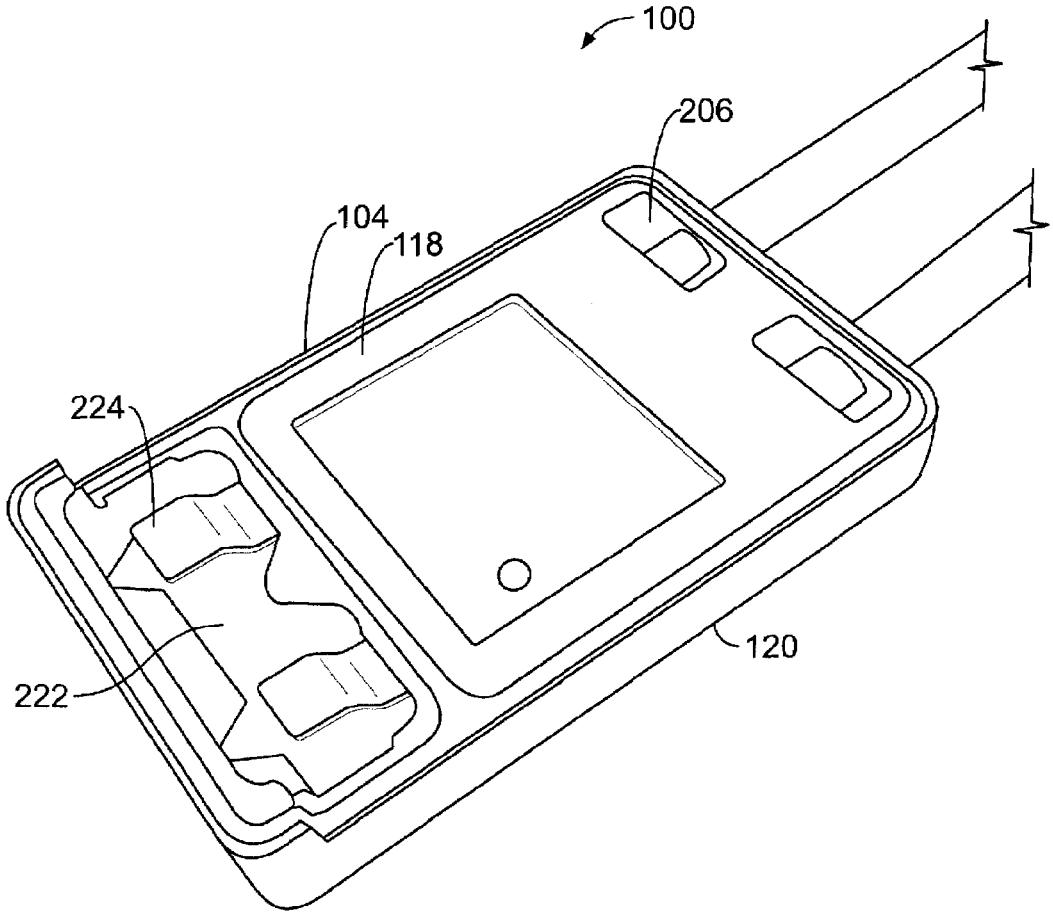
FIG. 3 is another perspective view of the connector shown in FIG. 1 in accordance with one embodiment.

FIG. 3 is another perspective view of the connector 100 in accordance with one embodiment. The view shown in FIG. 3 illustrates the mounting face 118 of the connector 100. In the illustrated embodiment, the cable windows 206 and the contact window 222 extend through the housing from the mounting face 118 to the opposite face 120. The contacts 224 extend into the contact window 222 from the housing 104. While two contacts 224 are shown, a different number of contacts 224 may be provided.

Figure 4:
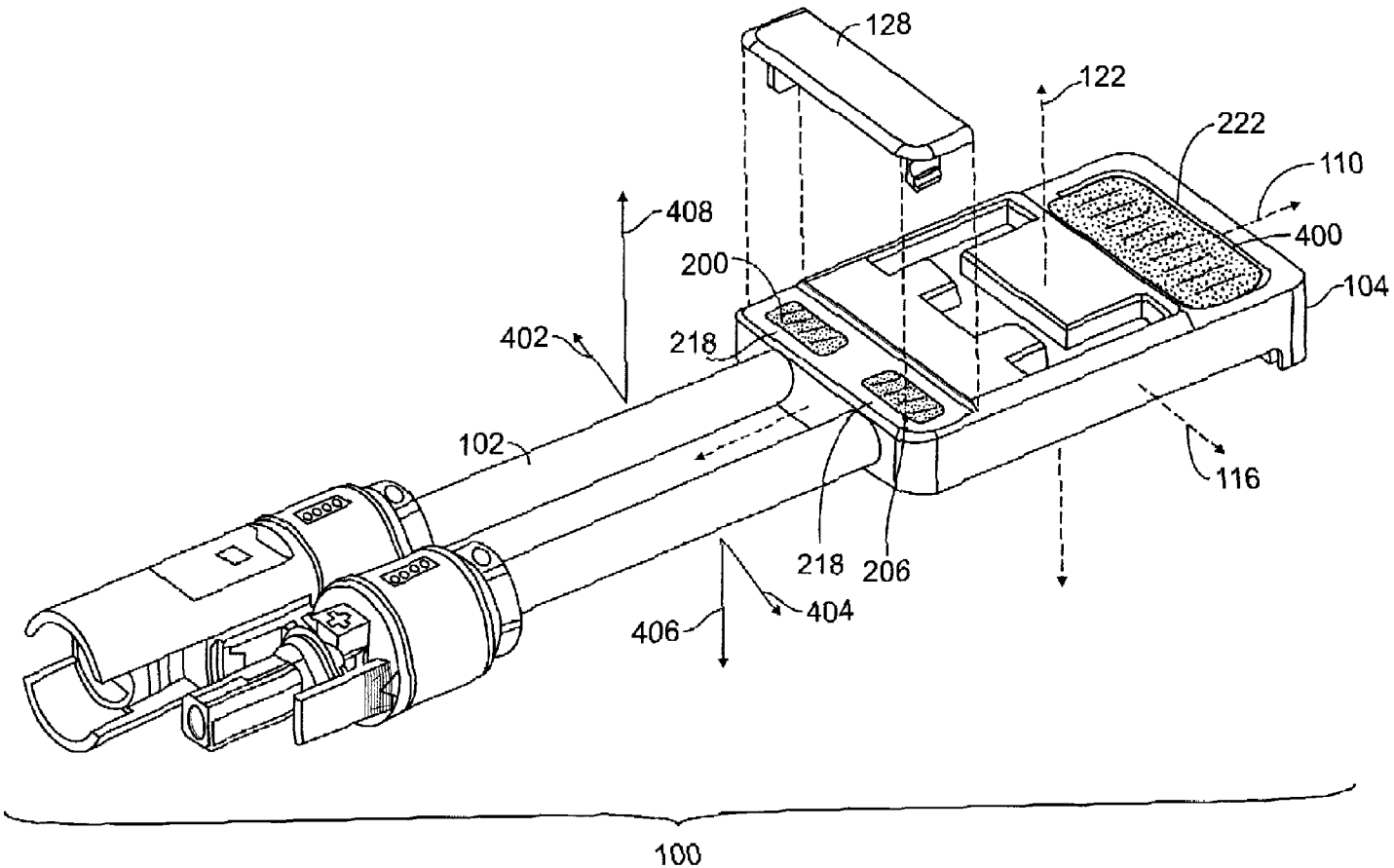
FIG. 4 is another partially exploded view of the connector shown in FIG. 1 in accordance with one embodiment.

FIG. 4 is another partially exploded view of the connector 100 in accordance with one embodiment. An encapsulant 400 is loaded into the cable windows 206 and the contact window 222. For example, a flexible potting material may be fluidly dispensed into the cavities defined by the cable windows 206 and the contact window 222. The encapsulant 400 may include one or more flexible materials such as, by way of example only, a room temperature vulcanized (RTV) silicone or other silicone-based material. In one embodiment, the encapsulant 400 is formed of a material that is more flexible than the housing 104. Alternatively, the encapsulant 400 may include or be formed from a rigid material. For example, the encapsulant 400 may be formed of the same material that the housing 104 is molded from. The same or different potting materials may be used as the encapsulant 400 in two or more of the cable windows 206 and contact window 222. The encapsulant 400 may be or include an adhesive material. For example, the encapsulant 400 may chemically and/or physically bond or adhere to the housing 104 and/or cables 102 inside the cable windows 206 when the encapsulant 400 cures.

The encapsulant 400 may be fluidly dispensed into the cable windows 206 and the contact window 222 after mounting the connector 100 to a mating device (not shown), such as a solar module. For example, the encapsulant 400 may be loaded into the cable windows 206 and/or the contact window 222 when the encapsulant 400 is in a state that allows the encapsulant 400 to flow like a liquid. The back end cover 128 and the front end cover 126 (shown in FIG. 1) may then be placed over the cable windows 206 and the contact window 222. The encapsulant 400 then cures in the cable windows 206 and in the contact window 222. The encapsulant 400 may adhere to the front end cover 128 and the rear end cover 126 to secure or assist in securing the front end cover 128 and the rear end cover 126 to the housing 104.

The encapsulant 400 in the cable windows 206 seals the interface between the cables 102 and the housing 104. For example, the encapsulant 400 may seal the interface between the cables 102 and each of the inner walls 208, 210 (shown in FIG. 2) of the housing 104. The encapsulant 400 seals the interfaces to prevent ingress of moisture into the housing 104. The sealing of the encapsulant 400 around the periphery of the cables 102 at the housing 104 prevents moisture from moving through the cable openings 212 (shown in FIG. 2) and into the housing 104.

The encapsulant 400 seals the interface between the cables 102 and the housing 104 during changes in temperature of the connector 100. For example, the outer jackets 124 of the cables 102 may have a coefficient of thermal expansion (CTE) that differs from the CTE of the housing 104. In one embodiment, the cables 102 have a CTE that is less than a CTE of the housing 104. The lower CTE of the cables 102 causes the cables 102 to expand or contact a smaller distance than the housing 104 in one or more directions for a common change in temperature. The different amounts of expansion and contraction between the cables 102 and the housing 104 for a common temperature change may result in a gap being formed between the cables 102 and the housing 104 at the interfaces between the cables 102 and the housing 104. For example, a gap may form at the interface between the cables 102 and the housing 104 at the cable openings 212. The encapsulant 400 seals this interface and any gap that forms at the interface to prevent ingress of moisture into the housing 104 through this interface.

In one embodiment, the encapsulant 400 has a CTE that is less than a CTE of the housing 104 and is greater than a CTE of the outer jackets 124 of the cables 102. For example, for a common change in temperature, the CTE of the encapsulant 400 may cause the encapsulant 400 to expand and contract a greater distance than the outer jackets 124 of the cables 102 but a lesser distance than the housing 104 in one or more directions. The CTE of the encapsulant 400 may be closer in value to a CTE of the housing 104 than to a CTE of the outer jackets 124. For example, the CTE of the encapsulant 400 may more closely match a CTE of the housing 104 than a CTE of the outer jackets 124. As described above, the encapsulant 400 may be a flexible material relative to the housing 104. The flexible characteristic of the encapsulant 400 and the CTE of the encapsulant 400 may enable the encapsulant 400 to maintain the seal at the interface between the cables 102 and the housing 104 to prevent a gap from forming over a change in temperature that would otherwise form a gap at the interface. For example, over a common temperature change, a gap would form at the cable/housing interface at the cable openings 212 if the encapsulant 400 was not disposed in the cable windows 206, while no gap would form at the interface if the encapsulant 400 is disposed in the cable windows 206.

In one embodiment, the encapsulant 400 may have an insufficiently low UV rating to withstand being exposed to sunlight. For example, the encapsulant 400 may break down and fail to seal the interfaces between the cables 102 and the housing 104 after being exposed to UV light for a sufficiently long time. In order to protect the encapsulant 400 from exposure to UV light, the rear end cover 128 and front end cover 126 may be placed over the cable windows 206 and the contact window 222, respectively. The front end cover 126 and rear end cover 128 may be formed of UV-rated materials that block all or substantially all of the UV light that is incident upon the connector 100. In one or more embodiments where the connector 100 is used with a solar module in an outside environment, the UV-rated front and rear end covers 126, 128 can protect the encapsulant 400 from UV light.

The web portion 218 of the housing 104 prevents the encapsulant 400 from being separated from the housing 104 at the interfaces between the encapsulant 400 and each of the inner walls 208, 210 (shown in FIG. 2). The web portion 218 also may prevent the encapsulant 400 from being separated from the cables 102 within the windows 206. During mounting of the connector 100 onto a mating device (not shown) and/or use of the connector 100, one or more of the cables 102 may be moved in directions that are angled with respect to the longitudinal axis 110. For example, the cables 102 may be moved in one or more transverse directions 402, 404 and vertical directions 406, 408 that are angled with respect to the longitudinal axis 110. Without the web portion 218, movement of the cables 102 in the transverse direction 402, 404 may impart a force on the encapsulant 400 at the interfaces between the encapsulant 400, the inner walls 208, 210, and the cable portions 216. For example, movement of the cables 102 may cause movement of the encapsulant 400 with respect to the housing 104. Movement of the encapsulant 400 relative to the housing 104 may cause separation between the encapsulant 400 and the housing 104. The forces imparted on the encapsulant 400 may cause the encapsulant 400 to separate from one or more of the inner walls 208, 210 and/or from the cable portions 216. For example, the force could separate the encapsulant 400 from the inner wall 208 and expose the interface between the cables 102 and the housing 104 at the cable openings 212.

The web portion 218 may isolate the encapsulant 400 from the forces that could separate the encapsulant 400 from the interfaces between the encapsulant 400 and the housing 104 and between the encapsulant 400 and the cables 102. For example, the web portion 218 can prevent or reduce movement of the cables 102 from imparting forces on the encapsulant 400 by isolating the portions 216 (shown in FIG. 2) of the cables 102 from movement of the cables 102 outside of the housing 104. The web portion 218 permits the sections of the cables 102 that are located outside of the housing 104 and the cable windows 206 to be moved in directions angled with respect to the longitudinal axis 110 while preventing the portions 216 of the cables 102 within the housing 104 to be moved. As the portions 216 of the cables 102 do not move, the portions 216 do not cause the encapsulant 400 to move or to impart any force on the interfaces at the encapsulant 400, the inner walls 208, 210 or the cable portions 216.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a housing extending from a cable exit to an opposite end along a longitudinal axis and from a mounting face to a top face along a vertical axis, the housing including a cable opening that extends into the cable exit in a direction parallel to the longitudinal axis and a window extending into the housing from the top face toward the mounting face in a direction parallel to the vertical axis;

a cable extending through the window and into the housing through the cable opening;

a contact held by the housing and electrically coupled with the cable;

an encapsulant disposed within the window to seal an interface between the cable and the housing, the encapsulant preventing ingress of moisture into the housing through the interface; and a cover disposed over the window and enclosing the encapsulant and a portion of the cable within the window;

wherein the housing comprises inner walls on opposing sides of the window with the cable opening disposed within one of the inner walls, an opening in other inner wall that is axially aligned with the cable opening such that the cable extends through the opening and the cable opening.

2. The connector of claim 1, wherein the encapsulant seals the interface around a periphery of the cable between the cable and the housing at the cable opening.

3. The connector of claim 1, wherein the housing comprises a web portion extending from the cable exit of the housing to the window, the web portion reducing force imparted on the encapsulant to prevent separation between the encapsulant and at least one of the housing and the cable.

4. The connector of claim 1, wherein the cable includes an insulative outer jacket, the encapsulant having a coefficient of thermal expansion that is less than a coefficient of thermal expansion of the housing and is greater than a coefficient of thermal expansion of the outer jacket of the cable.

5. The connector of claim 1, wherein the encapsulant comprises a flexible adhesive material.

6. The connector of claim 1, wherein each of the housing and the encapsulant comprises a rigid material.

7. The connector of claim 1, wherein the window defines an opening extending through the housing from the mounting face to the top face.

8. The connector of claim 1, wherein the mounting face of the housing is configured to be mounted to a solar panel to electrically couple the contact with the solar panel.

9. The connector of claim 1, wherein the cable extends through the window in a direction parallel to the longitudinal axis.

10. The connector of claim 1, wherein the window of the housing is a cable window and the housing includes a contact window that is separate from the cable window, the contact window comprising an opening that extends through the housing from the top face to the mounting face in a direction parallel to the vertical axis, the contact extending from the housing and into the contact window, further wherein the encapsulant is disposed within the contact window.

11. The connector of claim 10, wherein the cover is a first cover, further comprising a second cover disposed over the contact window, the first and second covers enclosing the portion of the cable within the cable window, the contact in the contact window, and the encapsulant in the contact window and in the cable window.

12. An electrical connector comprising:

a housing extending from a cable exit to an opposite end along a longitudinal axis and from a mounting face to a top face along a vertical axis, the housing framing a window extending through the housing from the top face to the mounting face;

a cable received into the housing through the cable exit, at least a portion of the cable disposed within the window;

a contact held by the housing and electrically coupled with the cable; and an encapsulant disposed within the window to seal an interface between the cable and the housing, wherein a web portion of the housing disposed between the cable exit and the window reduces a force that is imparted on the encapsulant to prevent separation between the encapsulant and at least one of the housing and the cable within the window;

wherein the housing comprises inner walls on opposing sides of the window, a cable opening disposed within one of the inner walls and an opening in other inner wall that is axially aligned with the cable opening such that the cable extends through the opening, across the window and into the cable opening.

13. The connector of claim 12, wherein the web portion isolates the force that is caused by movement of the cable outside of the housing in one or more directions that are angled with respect to the longitudinal axis.

14. The connector of claim 12, wherein each of the housing and the encapsulant comprises a rigid material.

15. The connector of claim 12, wherein the encapsulant has a coefficient of thermal expansion that is less than a coefficient of thermal expansion of the housing and is greater than a coefficient of thermal expansion of the cable.

16. The connector of claim 12, further comprising a cover disposed over the window to enclose the encapsulant and a portion of the cable within the window.

17. The connector of claim 12, wherein the window of the housing is a cable window and the housing includes a contact window that is separate from the cable window, the contact window comprising an opening that extends through the housing from the top face to the mounting face in a direction parallel to the vertical axis, the contact extending from the housing and into the contact window, further wherein the encapsulant is disposed within the contact window.

18. The connector of claim 17, further comprising covers disposed over the contact window and the cable window, the covers enclosing a portion of the cable within the cable window, the contact in the contact window, and the encapsulant in the contact window and in the cable window.

* * * * *